US006438866B1

(12) United States Patent
Meydell et al.

(10) Patent No.: US 6,438,866 B1
(45) Date of Patent: Aug. 27, 2002

(54) FLOW DISRUPTER FOR DRYERS

(75) Inventors: Stephan B. Meydell, Maple Grove; Cedric J. Adams, St. Paul, both of MN (US)

(73) Assignee: Carter Day International, Inc., Minneapolis, MN (US)

( * ) Notice: Subject to any disclaimer, the term of this patent is extended or adjusted under 35 U.S.C. 154(b) by 0 days.

(21) Appl. No.: 09/501,431

(22) Filed: Feb. 10, 2000

(51) Int. Cl.[7] ..... F26B 5/08

(52) U.S. Cl. ..... 34/312; 34/175; 34/184; 34/183; 34/189; 34/166; 34/173; 34/58; 34/59; 210/415; 210/320; 210/497.01

(58) Field of Search ..... 34/175, 184, 189, 34/183, 166, 173, 58, 59, 312; 210/415, 497.01, 320

(56) References Cited

U.S. PATENT DOCUMENTS 3,840,998 A * 10/1974 Marcussen ..... 34/128
4,155,841 A * 5/1979 Chupka et al. ..... 209/273
4,184,944 A * 1/1980 Tytko ..... 209/288
4,476,019 A * 10/1984 Nowisch et al. ..... 210/232
5,265,347 A * 11/1993 Woodson et al. ..... 34/58
5,607,589 A * 3/1997 Frejborg ..... 210/415
6,138,375 A * 10/2000 Humphries, II et al. ..... 34/59

* cited by examiner

*Primary Examiner*—William Doerrler
*Assistant Examiner*—Greg T. Warden
(74) *Attorney, Agent, or Firm*—Briggs and Morgan, PA

(57) ABSTRACT

The present invention provides a flow disrupter within the flow path of a slurry comprising a desired particulate matter and a transport fluid so as to impart a force angularly disposed to an otherwise obtained direction of travel, thereby preventing the formation of a sheet of aggregated particulates against the screen surface. In a method in accord with the present invention a force is imparted to the desired particulate matter in an angular direction to the direction of travel.

13 Claims, 3 Drawing Sheets

FLOW DISRUPTER FOR DRYERS

FIELD OF THE INVENTION

The present invention relates generally to devices and other apparatus useful in separating one material entrained in a slurry from the slurry transport fluid and finds particular use in a centrifugal dryer in preventing the aggregation against the screen of particulates entrained in the transport fluid, thus aiding in the drying of the particulates.

BACKGROUND OF THE PRESENT INVENTION

Centrifugal dryers are used to dry particulates carried by a transport fluid. A common use for them is the drying of plastic pellets entrained in a flow of water. An example of such a dryer is shown in U.S. Pat. No. 5,987,769 to Ackerman et al., which is also assigned to the present assignee of this application.

Centrifugal dryers typically include an upright rotatable rotor having a plurality of blades or paddles attached thereto and extending outwardly therefrom. Circumferentially disposed about the rotor is a screen with perforations small enough to prevent the desired particulates from passing therethrough and, preferably, from becoming lodged in the perforations. The rotor and screen are held within a shell. A slurry comprising a transport fluid, commonly water, and the desired particulates, such as newly formed plastic pellets, is introduced into the centrifugal dryer between the rotor and the screen at a slurry inlet closely adjacent to the bottom. As the slurry flows upwardly within the dryer, the transport fluid passes through the screen apertures whereas the particulates are trapped between the rotor and the screen. The blades engage the particulates and, desirably, "bounce" them back and forth between the screen and the rotor/blades, causing the pellets to dry as they move upwardly within the dryer to an outlet at the top of the dryer.

In operation of such centrifugal dryers, it has been found that the particulates will at times aggregate against the screen and will not in fact rebound between the screen and the rotating rotor with attached blades. The aggregated particulates tend to form a thin "sheet" that embraces the screen and that is held there by the outward air and water flow created by the rotating rotor. Additionally, it has been found that the sheet will rotate around the inside circumference of the screen, though at a much slower rate than the rotation of the rotor itself. After a sufficient mass of particulates aggregate into the sheet, the sheet will collapse, with the particulates falling into the rotor causing a great noise and creating additional wear and tear on the dryer.

It would be desirable to have a centrifugal dryer that was not subject to the foregoing deficiencies and that would prevent the aggregation of particulates into a thin sheet lying against the inner surface of the screen.

SUMMARY OF THE INVENTION

It is an object of the present invention to provide new and improved apparatus that is not subject to the foregoing disadvantages.

It is another object of the present invention to provide an apparatus and method for enhancing the turbulent flow of particulates entrained in a transport fluid.

It is still another object of the present invention to provide an apparatus and method for substantially preventing the formation of a sheet of aggregated particulates in a centrifugal dryer against the dryer screen.

The foregoing objects of the present invention are provided generally by including a flow disrupter within the flow path of a slurry comprising a desired particulate matter and a transport fluid so as to impart a force angularly disposed to an otherwise obtained direction of travel. In a method generally in accord with the present invention a force is imparted to the desired particulate matter in an angular direction to the direction of travel. In one embodiment of the present invention, a centrifugal dryer useful for removing the transport fluid from the particulates entrained therein may include an upright, substantially cylindrical screen having a plurality of apertures sized to allow the transport fluid to flow through but not the entrained particulates. The dryer may include an inwardly directed flange that imparts a radially inward direction of force to the aggregating particulates, causing them to move radially inwardly into contact with the rotor blades, thus restoring the intended reciprocal bouncing of the particulates between the rotor and the screen.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Figure 1:
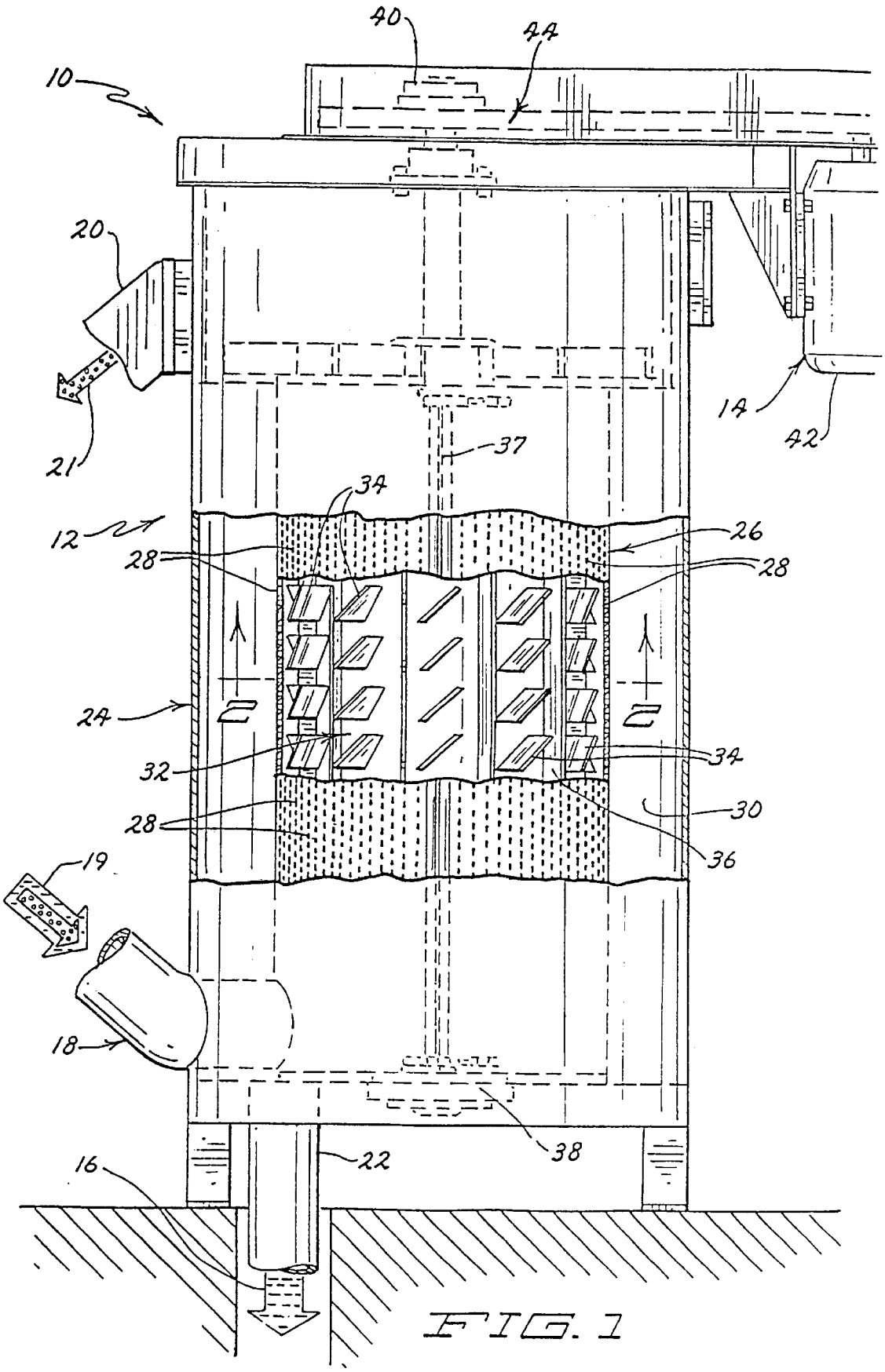
FIG. 1 illustrates in a side elevation, partial phantom view a centrifugal dryer where the present invention may find use.

A centrifugal dryer 10 is shown in a side elevation view in FIG. 1. Dryer 10 includes a dryer section or portion 12, and a dryer motor section or portion 14. Often, a dryer 10 may include a dryer reservoir section (not seen, but typically disposed below such a dryer 10 as indicated by flow arrow 16). A product slurry, such as a plastic bead or sphere/water mixture, is introduced into the dryer 10 by means of an inlet pipe 18 as indicated by arrow 19. Typical known prior art dryers such as dryer 10 utilize a side inlet for the slurry that introduces a slurry flow into the dryer section substantially transverse to the axis of rotation of the rotor. Dried product is removed from the dryer 10 through a product discharge chute 20 as indicated by arrow 21 while the transport fluid, such as water, "removed" from the dried product is discharged or drained from the dryer section 12 through an outlet pipe 22.

The dryer section includes an outer cylindrical housing or shell 24. Disposed therewithin is a cylindrical screen 26 having a plurality of apertures 28 configured to allow the passage of the transport fluid through the screen into the internal fluid collection reservoir 30 formed by the spaced apart housing 24 and screen 26. Fluid collected in collection reservoir 30 flows through the outlet 22 into the dryer reservoir (unseen as previously noted) as indicated by the arrow 16. Axially disposed relative to the cylindrical housing 24 and screen 26 is a rotor 32. Rotor 32 also has a substantially cylindrical configuration and includes a plurality of blades 34, as shown arranged in a plurality of rows, and a plurality of kickers 36 extending longitudinally along the rotor 32. The rotor 32 may include a solid central shaft 37 that is mounted for rotation by a bearing housing 3 8 at the bottom end thereof and by a bearing housing 40 at the top end thereof.

The motor section 14 includes a drive motor 42. The rotor 32 is drivingly connected to the motor 42 by a drive train 44 which may be of any suitable known type sufficient to handle the loads and stresses generated by operation of the dryer 10.

Figure 3:
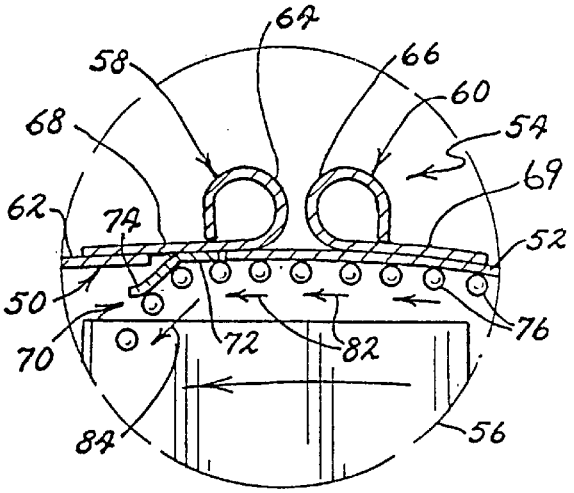
FIG. 3 illustrates the in greater detail the joint shown in FIG. 2.
Figure 4:
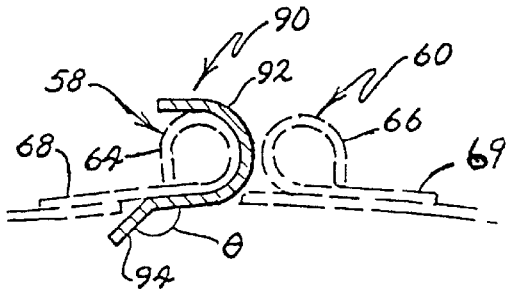
FIG. 4 shows an alternative embodiment of a flow disrupter in accord with the present invention.
Figure 2:
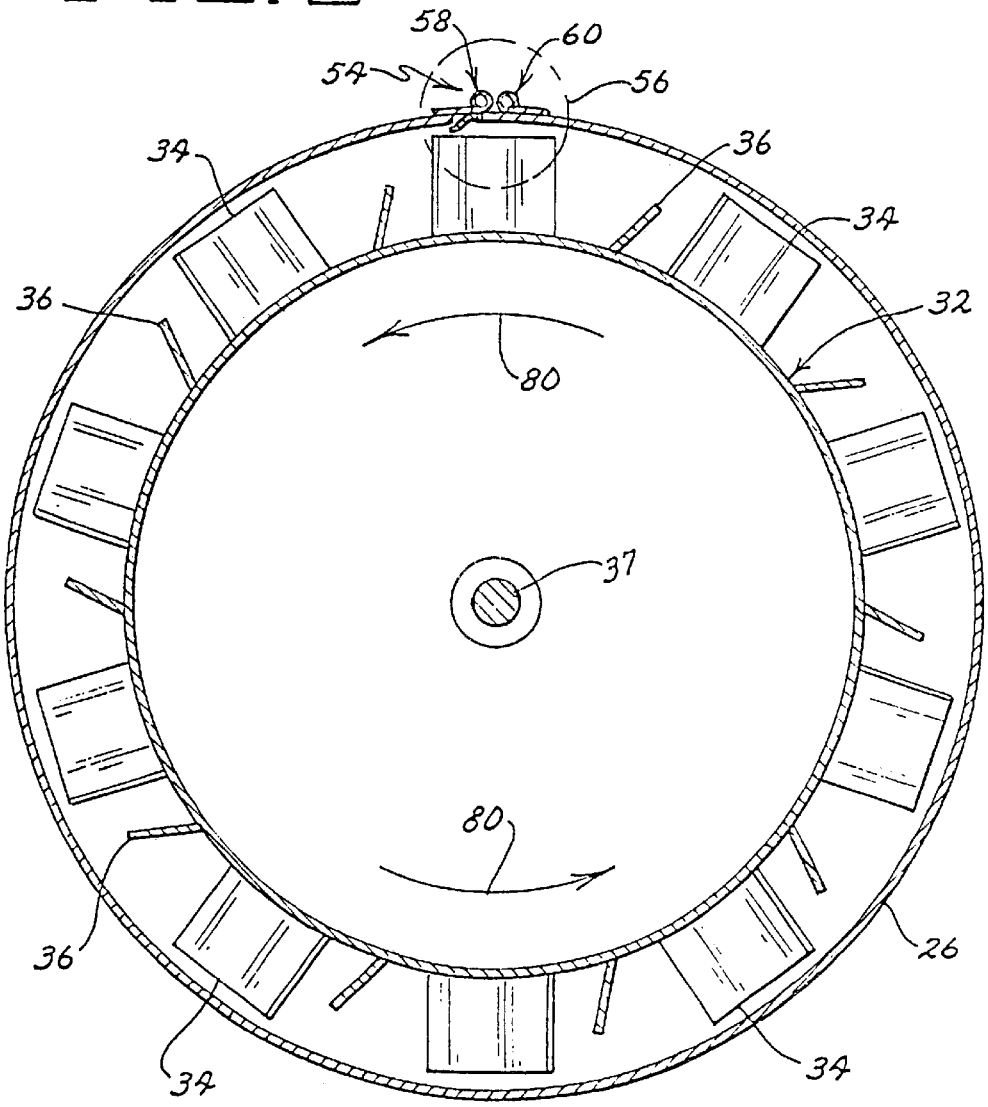
FIG. 2 illustrates the centrifugal dryer shown in FIG. 1 in a top view taking along viewing plane 2—2 of FIG. 1.

Referring now to FIGS. 2–4, it will be observed that screen 26 is manufactured as a substantially planar screen and then rolled into a cylindrical configuration. Thus, the screen 26 includes a pair of opposed edges 50, 52 that are attached to each other in any known way sufficient to stand the loads and stresses generated during operation of the dryer 10 to form a joint 54 as shown in the detail 56 of FIGS. 2 and 3. As shown in the Figures, the edges 50 and 52 each include a latch assembly loop 58, 60, respectively. Loops 58 and 60 are typically spot welded to the outer screen surface 62 adjacent the edges 50 and 52, respectively. The loops 58 and 60 are used in common latch assemblies that are used to tightly and closely attach the edges 50 and 52 to each other as indicated in the Figures. Such a complete latch assembly can be found on many known prior art dryers and sorter/separators used commercially and will not be further discussed here.

Each loop 58, 60 includes a loop portion 64, 66, respectively, and an attachment portion 68, 69, respectively. The attachment portions 68 and 69 are substantially planar but may be curved slightly to conform to the configuration of the screen surface when formed into its operation configuration of a cylinder.

It will be observed that loop 58 is attached to the edge 50 so as to extend therebeyond, thereby providing an interference with the free end 52. That is, the loop 58 and the end 52 will engage when attached with the loop 58 aiding in holding the screen in a circular configuration by its interference with the trapped edge 52. Thus, FIG. 3 shows the edge 52 engaging loop 58 at the loop portion 66, thereby otherwise leaving a gap between edge 52 and edge 50 when the screen edges are attached.

Still referring to FIG. 3, it will be observed that a flow disrupter 70 has been attached to the inner surface of the attachment portion 68 of the loop 58. Disrupter 70 includes a disrupter attachment portion 72 and a disrupter ramp 74. The disrupter attachment portion 72 is configured for attachment to loop attachment portion 68 of loop 58 in any known manner sufficient to withstand operational rigors, such as welding. The disrupter attachment portion 72 is attached to the loop 58 attachment portion 68 and sized such that when the edges 50, 52 are attached to form the circular screen there is only a very small gap between the edge 52 and the disrupter attachment portion 72, thereby substantially preventing the lodging of any of the particulates 76 within that gap. The ramp portion 74 extends angularly inwardly from the disrupter attachment portion 72 as indicated. As shown, portions 72 and 74 form an obtuse angle Θ (indicated in FIG. 4) of substantially 135° relative to each other, with preferably, $$130° \leqq \Theta \leqq 160°.$$

The particular angle Θ chosen for the disrupter bar will depend upon several factors, including the tangential velocity of the "sheet" of aggregated particles, the pressure exerted by the outward flow of the air produced by the rotor 32, and the gap between the screen 26 and the tips of the rotor blades 34. As the tangential velocity increases, the angle Θ can be decreased, assuming the air pressure generated by the rotor rotation remains constant. Should the air pressure increase, then the ramp angle Θ will have to be increased to overcome the force of the air against the inward motion of the particulates. In sum, the angle Θ is inversely related to the tangential velocity of the "sheet" and to the air pressure generated by the rotor airflow.

It will be further understood that the angle Θ as described herein is the angle between the ramp surface and a surface lying perpendicular to a radius of the substantially circular screen 26. As shown in the Figures, the surface of the attachment portion 72 is substantially perpendicular to such a radius.

Advantageously, the disrupter 70 is made of material having a thickness substantially equal to that of the screen 26. That is, the screen has a thickness $t_s$ and the disrupter similarly is made of a material having a thickness substantially equal to $t_s$. In this manner, then, a substantially continuously curved surface can be presented to the particulates, thus helping to avoid the aggregation of particulates at the location of the disrupter.

In operation, rotor 32 will rotate as indicated by arrow 80 in FIGS. 2 and 3. The rotor's rotational action will impart an outward force to the slurry, directing it against the screen. Particulates 76 will separate from the transport fluid as the fluid flows through the screen apertures 28 while the particulates bounce against the screen. As noted, the particulates will be bounced back and forth between the screen 26 and the rotor 32 and its associated blades 34 and kickers 36, continuously removing the transport fluid therefrom. Additionally, the particulates will be bounced upwardly toward the outlet 20 by both the action of the blades 34 and kickers 36 and the air flow generated by the rotation of the rotor 32. Particulates 76 that may otherwise aggregate against the screen and slowly rotate thereagainst, as indicated by arrows 82, will encounter the disrupter 70, and particularly the disrupter ramp 74, which will impart an inwardly directed force to the particulates, causing them to break apart from the sheet and to be directed inwardly as indicated by arrow 84 to re-engage the blade and kickers.

Referring now to FIG. 4, an alternative embodiment of a flow disrupter 90 in accord with the present invention is illustrated. Disrupter 90 is attached to the loop portion 64 of the loop 58. That is, disrupter 90 includes an attachment portion 92 and a disrupter ramp portion 94. The disrupter attachment portion is configured to wrap around the loop portion 64; as shown, the disrupter attachment portion 92 has a substantially semi-circular configuration to conform to the circularly configuration of the loop. Disrupter 90 can be attached in any known manner, such as welding, to the loop 58. As with the disrupter 70, the disrupter ramp portion 94 may be disposed at an (angle Θ relative to disrupter attachment portion 92 of substantially 135° relative to each other, with preferably, $$130° \leqq \Theta \leqq 160°.$$

The disrupters 70 and 90, and thus the ramps 74 and 94, respectively, may extend substantially the entire vertical extent of the dryer 10. Alternatively, the ramps 74 and 94 may be advantageously broken into a plurality of smaller ramp segments extending a fractional portion of the extent of the screen.

Figure 5:
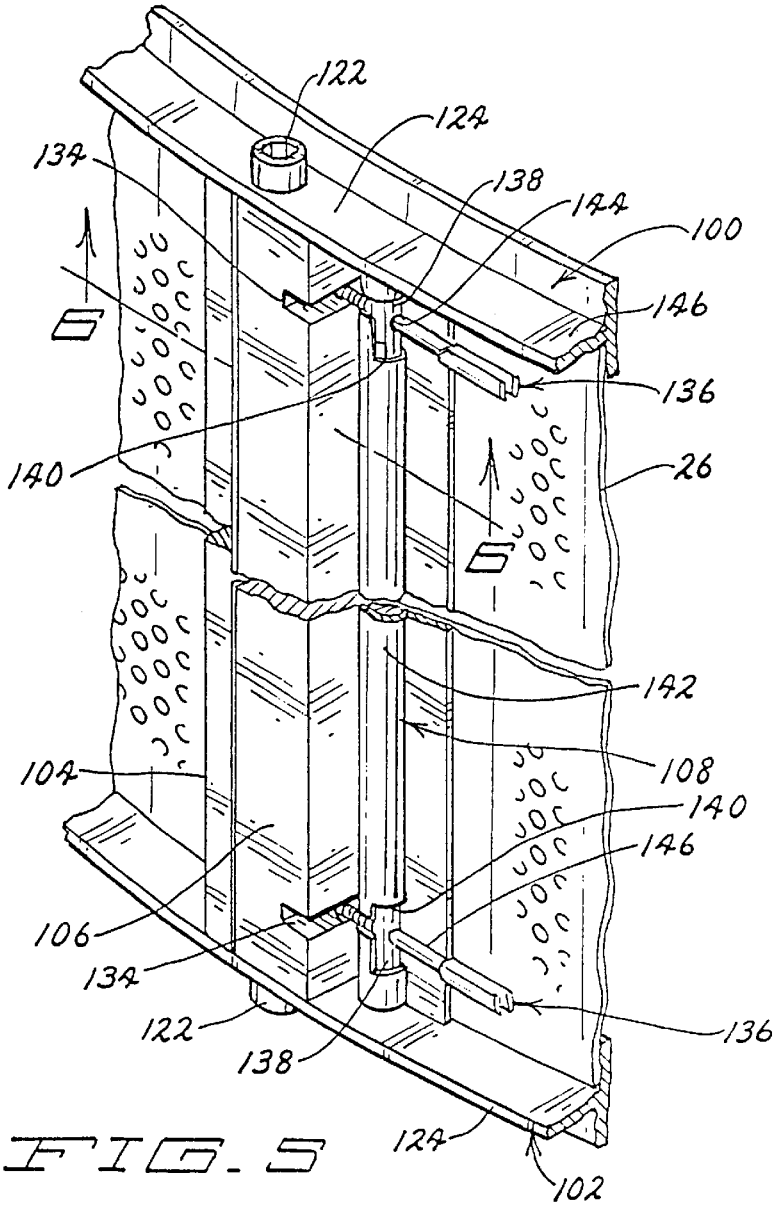
FIG. 5 is a perspective view of a portion of a dryer screen and associated support hoops and including a flow disrupter bar in accord with the present invention.

An alternative embodiment of the present invention including a screen attachment assembly will now be described with reference to FIGS. 5 and 6. As seen there, screen 26 is supported by upper and lower screen support hoops 100 and 102, respectively, with each hoop having a substantially T-shaped cross-section as shown in the Figures. The screen 26 is secured to the hoops 100, 102 by means of a screen clamp bar 104, a screen disrupter bar 106, and a screen clamp 108. It will be seen that the screen 26 includes a radially outwardly directed flange 110 having a plurality of though holes 112. The flange 110 is captured between the screen clamp bar 104 and the screen disrupter bar 106. The screen clamp bar 104 includes a plurality of recessed through holes 114 capable of receiving a threaded bolt 116 whose threaded shaft 118 extends through the through holes 114 in the screen clamp bar 104 and the through holes 112 of the flange 110 into a threaded hole 120 within the screen disrupter bar 106.

The screen disrupter bar 106 includes a pair of opposed threaded holes at the ends thereof capable of receiving a bolt 122 inserted through a through hole in the horizontal flange 124 of the support hoops 100 and 102. In this manner then, the screen disrupter bar 106 is attached to the support hoops and one of the two free ends of the screen 26 is captured between the screen clamp bar 104 and the screen disrupter bar 106 and is held relative to the support hoops 100, 102.

The screen disrupter bar 106 further includes at each end thereof a hole 130 that rotatably receives a latch pin or plug 132. The hole 130 extends into the screen disrupter bar 106 beyond a slot 134 therein such that the latch pin 132 extends beyond the slot 134. The latch pin 132 includes a threaded hole sized to threadably receive the threaded end 135 of a latch handle 136. Thus, because the latch pin 132 is rotatably received within the pin hole 130, the latch handle 136 can be pivoted about the latch pin 132.

It will further be observed that the latch handle 136 includes a rod 138 sized to be received by a loop slot 140 in the rolled loop 142. The rod 138 includes a smooth through hole 144 sized to receive the shaft 146 of the latch handle 136.

Thus, to attach the screen 26 to the hoops 100, 102 the screen disrupter bar 106 will be attached to the hoops with the bolts 122. The screen 26 will be placed around the hoops with the flange 110 engaging the screen disrupter bar 106. The screen clamp bar 104 will then be attached to the screen disrupter bar 106 with the bolts 116, capturing the flange 110. The other end of the screen 26 will then be positioned such that the latch handle 136 can be pivoted so that the rod 138 is disposed within the loop slot 140 of rolled loop 142. The latch handle 136, which can have a hex configuration to be used with a wrench, will then be threaded into the latch pin 132 until the shoulder 147 of the latch handle 136 engages the rod 138, which is captured and held within the rolled loop 142.

Figure 6:
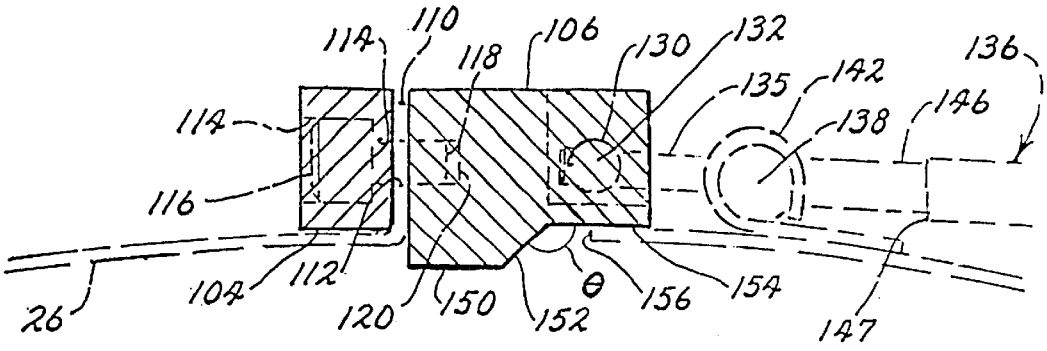
FIG. 6 is a cross sectional view of the apparatus shown in FIG. 5 taken along viewing plane 6—6 thereof.

Referring now to FIG. 6 in particular, the screen disrupter bar 106 will be described in additional detail. The bar 106 includes a disrupter portion 150 extending into the space between the screen 26 and the blades 34. The disrupter portion 150 includes a ramp 152 disposed at the angle Θ of about 135° relative to the screen engagement surface 154 of the disrupter bar 106, with preferably, $$130° \leqq \Theta \leqq 160°.$$

The screen engagement surface, as shown, is substantially planar and will lie perpendicular to a radius drawn from the axis of rotation of the rotor.

Still referring to FIG. 6, it will be observed that the screen flange 110 and the screen end 156 are spaced apart from each other by an amount substantially equal to the width of the screen disrupter bar 106. The screen disrupter bar 106 forms not only a rigid attachment point for the screen 26, but also provides the flow disruption function previously described.

The present invention further contemplates a method for preventing the formation of a rotating sheet of aggregated particulates. In a method in accord with the present invention a dryer having a rotor including a plurality of blades and a screen disposed substantially concentrically thereabout is provided. The screen includes an inner surface and a plurality of apertures configured to allow the transport fluid to pass therethrough but not the particulates. A slurry comprising a transport fluid and a desired particulate is provided to the dryer and the rotor is rotated such that the slurry is directed outwardly therefrom. An inwardly directed force is applied to the particulates as they rotate along the screens inner surface to redirect their motion back toward the rotor, thereby acting to inhibit the aggregation of the particulates into a rotating sheet. Further, in a method in accord with the present invention, the force is provided by disposing a ramp substantially adjacent to the screen inner surface, the ramp forms an angle Θ relative to a surface disposed substantially perpendicular to a radius of the screen and wherein $130° \leqq \Theta \leqq 160°$. Preferably, in a method in accord with the present invention, Θ is about 135°.

The present invention having thus been described, other modifications, alterations, or substitutions may now suggest themselves to those skilled in the art, all of which are within the spirit and scope of the present invention. For example, it will be noted that the dryer shown in the '769 patent to Ackerman et al. includes an inlet pipe that introduces the product slurry into the center of the dryer section and along the axis of rotation of the rotor. It is therefore intended that the present invention be limited only by the scope of the attached claims below.

What is claimed is:

1. A centrifugal dryer for separating and drying a particulate material entrained within a transport fluid, said dryer comprising a dryer section, said dryer section including a housing, a screen disposed within the housing and having and inner and an outer surface, and a rotor, wherein said dryer includes a flow disrupter comprising a ramp, said disrupter attached to said screen and said ramp directed inwardly;

said screen includes at least first and second cooperating latch assembly loops, each said loop including an attachment portion for attachment thereof to said screen and a loop portion, and wherein said disrupter is attached to said first latch assembly loop portion; and said disrupter further includes a disrupter attachment portion, said ramp and said disrupter attachment portion having substantially planar configurations, wherein said ramp and said disrupter attachment portion form an angle θ relative to each other and said disrupter attachment portion has a substantially semicircular configuration and said first loop assembly loop portion has a substantially circular configuration, said first loop assembly loop portion being received within said disrupter attachment portion.

2. The dryer of claim 1 wherein said screen includes at least first and second cooperating latch assembly loops, each said loop including an attachment portion for attachment thereof to said screen and a loop portion, and wherein said disrupter is attached to said first latch assembly loop attachment portion.

3. The dryer of claim 2 wherein said screen has a thickness $t_s$ and said ramp has a thickness substantially equal to $t_s$.

4. The dryer of claim 2 wherein said disrupter further includes a disrupter attachment portion, said ramp and said disrupter attachment portion having substantially planar configurations, and wherein said ramp and said disrupter attachment portion form an angle Θ relative to each other.

5. The dryer of claim 4 wherein θ is about 135°.

6. The dryer of claim 5 wherein 130°≦Θ≦160°.

7. A centrifugal dryer for separating and drying a particulate material entrained within a transport fluid, said dryer comprising a dryer section including a pair of screen support hoops;

a flow disrupter bar attached to and extending between said support hoops;

a screen attached to said flow disrupter bar; and a rotor, wherein:

said flow disrupter bar includes a ramp extending inwardly;

said screen includes a pair of ends and a first of said ends includes an outwardly directed flange with at least one through hole;

said flow disrupter bar includes at least one threaded hole corresponding to said at least one flange through hole; and said dryer further includes a screen clamp bar having at least one through hole corresponding to said at least one flange through hole, wherein said screen is attached to said flow disrupter bar by a bolt extending through said screen clamp bar through hole, said flange through hole and into threaded engagement with said screen disrupter bar threaded hole.

8. The dryer of claim 7 wherein said flow disrupter bar includes a screen engagement surface for engaging the second of said screen ends.

9. The dryer of claim 8 wherein said screen engagement surface and said ramp form an angle Θ relative to each other wherein 130°≦Θ≦160°.

10. The dryer of claim 9 wherein Θ is about 135°.

11. The dryer of claim 7 wherein said screen includes a pair of ends and said flow disrupter bar includes a screen engagement surface for engaging one of said screen ends.

12. The dryer of claim 8 wherein said screen engagement surface and said ramp form an angle Θ relative to each other wherein 130°≦Θ≦160°.

13. The dryer of claim 12 wherein Θ is about 135°.

* * * * *